US005287897A

United States Patent [19]

Gamberini

[11] Patent Number: 5,287,897

[45] Date of Patent: Feb. 22, 1994

[54] MACHINE FOR DOSING POWDERED PHARMACEUTICALS

[75] Inventor: Ernesto Gamberini, Rostignano-Pianoro, Italy

[73] Assignee: MG2 S.p.A., Pianoro, Italy

[21] Appl. No.: 820,307

[22] Filed: Jan. 10, 1992

[30] Foreign Application Priority Data

Jan. 15, 1991 [IT] Italy ..... BO91A000006

[51] Int. Cl.[5] ..... B65B 43/42; B67C 3/00

[52] U.S. Cl. ..... 141/130; 141/181; 141/73; 141/178; 141/280; 222/160

[58] Field of Search ..... 141/69, 71, 73, 81, 141/12, 236, 237, 238, 242, 243, 244, 245, 250, 266, 284, 280, 130, 65, 67, 158-160, 163, 178, 181; 222/160, 162, 227, 233, 234, 243-245

[56] References Cited

U.S. PATENT DOCUMENTS

| | | | |
|---|---|---|---|
| 2,932,330 | 4/1960 | Donofrio | 141/181 |
| 3,656,517 | 4/1972 | Taylor et al. | 141/144 |
| 3,847,191 | 11/1974 | Aronson | 141/71 |
| 4,116,247 | 9/1978 | Zanasi | 141/81 |
| 4,501,307 | 2/1985 | Moser et al. | 141/71 |
| 4,542,835 | 10/1985 | Gamberini | 141/71 |
| 4,884,602 | 12/1989 | Yamamoto et al. | 141/67 |

FOREIGN PATENT DOCUMENTS

| | | |
|---|---|---|
| 897199 | 5/1962 | United Kingdom . |
| 2192381 | 7/1986 | United Kingdom . |

*Primary Examiner*—Henry J. Recla
*Assistant Examiner*—Steven O. Douglas
*Attorney, Agent, or Firm*—Ladas & Parry

[57] ABSTRACT

A machine for dosing powdered pharmaceutical from a container in which the powdered pharmaceutical is present as a layer. An element is driven by a first drive to undergo horizontal translation between a first position for sampling powder in the container and a second position for release of the powder into a receiving seat. A device which supports a dosage unit is moved by the element and when the element is in the first position a second drive translates the device vertically in relation to the element so that the dosage unit penetrates into the powder and removes a measured amount thereof. A third drive operates the dosage unit to release the powder therefrom into the receiving seat when the element is in the second position. The first and second drives are independently operable to displace the dosage units respectively in horizontal and vertical directions.

20 Claims, 4 Drawing Sheets

MACHINE FOR DOSING POWDERED PHARMACEUTICALS

BACKGROUND OF THE INVENTION

The present invention relates to a machine for dosing powdered pharmaceuticals. Mainly two types of machines for dosing powdered pharmaceuticals are known to be available; the first type is called a "rotary machine" and the second an "alternating machine". The rotary machine presents noticeable advantages compared with the alternating machine such as, for instance, a higher precision of the amount to be dosed and a higher hourly production. But it has the drawback of not being fit for dosing on the sheets of the blister packing system. On the other hand, though being less convenient than the rotary machine, the alternating machine can perform the dosage within any seat whether defined by a blister of the blister sheet, by a bottle or by a gelatin capsule. Current alternating machines mainly comprise two plates provided with a plurality of measurers and carried by a respective arm radially extending from a rotating shaft and axially translatable. Naturally the plates carrying the measurers diametrically oppose each other. The operation of the alternating machine provides the translation of the rotating shaft downwards so that while the measurers of a first plate go and take the powder out of the container the measurers of the second plate go and dose the powder, for instance on the blister sheet. Then the shaft goes up again and rotates by 180° so as to allow, with its successive lowering, a new powder sampling and a new dosage. The aforedescribed alternating machines present some drawbacks.

Particularly, the rotation of the shaft produces vibrations which are transmitted to the measurers and part of the powder can drop therefrom. Therefore, in these machines, we notice an insufficient precision of the amount of product to be dosed. Besides, said dosage precision also depends on the perfect levelling to be defined between the two plates carrying the measurers. It is apparent that a perfect levelling requires that the machine should be provided with high-precision mechanical components and, consequently, high production costs of said machine. Finally, it should be underlined that, considering that said machines operate at a sustained rate, the wear of some of said components produces a progressively small shift between the levels of the two plates.

SUMMARY OF THE INVENTION

The object of the present invention is to provide a machine for dosing powdered pharmaceuticals which eliminates the drawbacks of the alternating machines previously mentioned, and which, though being an alternating machine, presents a high dosage precision and an hourly production equal to the production of rotary machines.

Other purposes and advantages of the present invention will be made apparent from the description given hereinafter. In accordance with the present invention there is provided a machine for dosing powdered pharmaceuticals characterized in that it comprises:

a container in which there is a layer of said powder;

a device carrying a dosage unit;

an element able to translate parallel to its own axis between two positions, a first one relative to the sampling of said powder and a second one relative to the release of said powder into at least one of the seats and able, while translating, to move said device;

first means for producing the motion of said element;

second means able to bring about, when said element takes said first position, the translation along the above mentioned vertical axis of said device in relation to said element so that said dosage unit can penetrate the layer of said powder and take a preset amount of it; and third means able to bring about, when said element takes said second position, the dosage, that is to say able to operate the release of said powder from said dosage unit toward said seat.

BRIEF DESCRIPTION OF THE DRAWINGS

The present invention will be more apparent from the description of a preferred embodiment thereof given hereinafter by way of non-limiting example with reference to the accompanying drawings, in which.

DETAILED DESCRIPTION OF THE INVENTION

Figure 1:
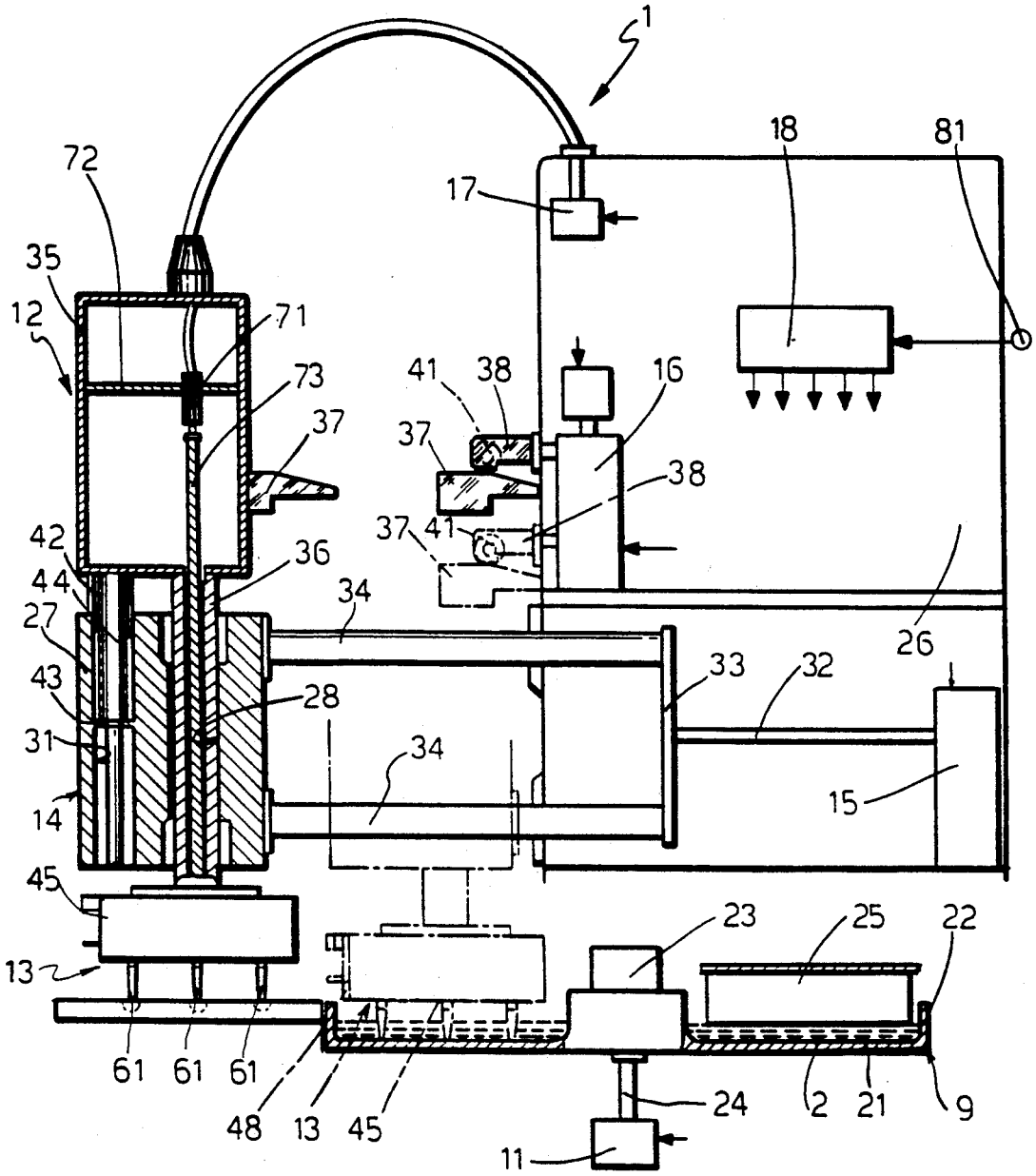
FIG. 1 is a side elevational view, shown in partial section, of the machine constructed in accordance with the present invention.
Figure 3:
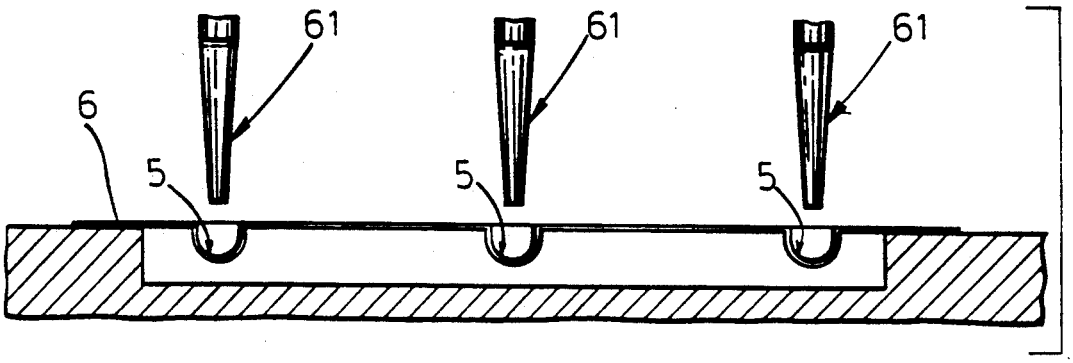
FIGS. 3 and 4 show various forms of a detail of the machine of FIG. 2.
Figure 4:
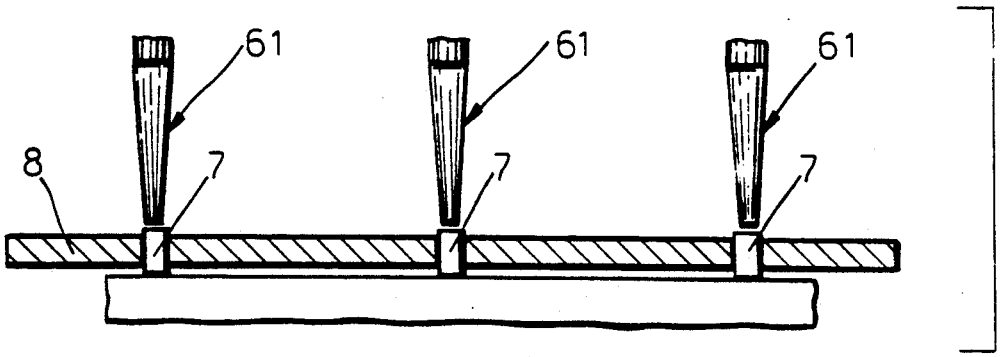

According to what is shown in FIG. 1 the reference numeral 1 indicates overall an "alternating machine" for dosing powdered pharmaceuticals 2. The machine 1 is part of a plant which provides a system for supplying the powder 2, a system for conveying the seats or containers to be filled, and a system for manufacturing said seats or containers. The plant can be also provided with a system for compacting the powder 2 and with a second machine for dosing a different pharmaceutical. As will be shown hereinafter, the machine 1 can fill hard gelatin capsules 3 carried by a plate 4 (FIG. 2), within blisters 5 provided on a sheet 6 of blister-type packing (FIG. 3), in glass or plastic bottles 7 carried by a plate 8 (FIG. 4), or in suitable seats provided in a plate or belt. Moreover, the various possible ways of conveying the seats to be dosed through the machine 1 will be described hereinafter.

The machine 1 comprises:

a container 9 constantly supplied with powder 2 and arranged to rotate with predetermined modalities about a vertical axis;

means 11 for driving the container 9;

a device 12 supporting a dosage unit 13;

an element 14 supporting the device 12;

means 15 able to bring about translation of element 14 in a direction parallel to the vertical axis of the element 14;

means 16 able to bring about, during the powder 2 sampling phase, the translation along said vertical axis of the device 12 in relation to the element 14;

means 17 able to bring about the dosage, that is to say able to operate the release of the powder 2 from the unit 13; and a computer 18 for operating the means 11, 15, 16 and 17.

The means 11 preferably consists of an electric motor bringing about the stop and go rotation of the container 9. The container 9 cylindrical and comprises a base wall 21, a cylindrical side wall 22 of reduced height, and a hub 23 angularly fixed to the driven shaft 24 of said motor. Within the container 9 there is diagrammatically shown a block 25 which represents a device which, after each powder sampling, is able to mix the powder 32 and to shave the layer of powder so as to constitute a layer which is even in relation to the density. At a higher level of the container 9 the machine 1 is provided with a fixed frame 26 in a lower portion of which there are situated the means 15 and in an upper portion of which there are situated the means 16 and 17 and preferably the computer 18 diagrammatically indicated as a block.

With reference to FIG. 1 the element 14 comprises a body 27 having a vertical, longitudinal axis and having two through bores 28 and 31 mutually parallel and parallel to said longitudinal axis. The means 15 is able to bring about the axial translation of a horizontal rod 32 which, at an axial end, is mechanically rigid with a vertical plate 33. The body 27 is mechanically fixed to the plate 33 by means of two horizontal arms 34, in order to bring about the translation of the body 27 parallel to its longitudinal axis. In particular the body 27 is able to translate between a position close to the frame 26 and in which the unit 13 is in the space in the container 9 so as to perform the sampling of the powder 2, and a position in which the unit 13 is outside said space but is close to a space defined by the seat to be dosed so as to perform the dosage.

With reference to FIG. 1 the device 12 comprises a box 35 situated above the body 27 and arranged to be moved by the latter during the operation of the means 15.

From a base wall of the box 35 an internally hollow, vertical shaft 36 extends which goes right through the bore 28 and which, at its lower end, supports the dosage unit 13 below the body 27. From a wall of the box 35, facing the frame 26, an appendix 37 extends toward said frame. As previously mentioned the box 35 is arranged to translate, for the coupling with the body 27, with the same modalities as the latter.

The means 16 is able to bring about the downward and upward translation of a pin 38 which carries a small wheel 41. The pin 38 extends from the frame 26 toward the box 35. When the latter takes a position close to the frame 26 the small wheel 41 comes into contact with the upper face of the appendix 37, so that the operation of the means 16, causes the downward translation of the pin 38 which brings about an equal translation of the box 35 and of the unit 13. During this phase the unit 13 extends inside the container 9 and takes a sample of the powder 2. After the sampling phase the means 16 operate the upward translation of the pin 38, therefore the box 35 and the unit 13 also are free to translate upwards.

The upward translation of the box 35 and therefore of the unit 13 is brought about by the action of a spring 42 making contact between the base wall of the box 35 and a shoulder provided within the bore 31. To prevent the device 12 from rotating about the axis of the shaft 36 for any reason, a pin 44 extends from the base wall of the box 35 inside the bore 31.

Figure 2:
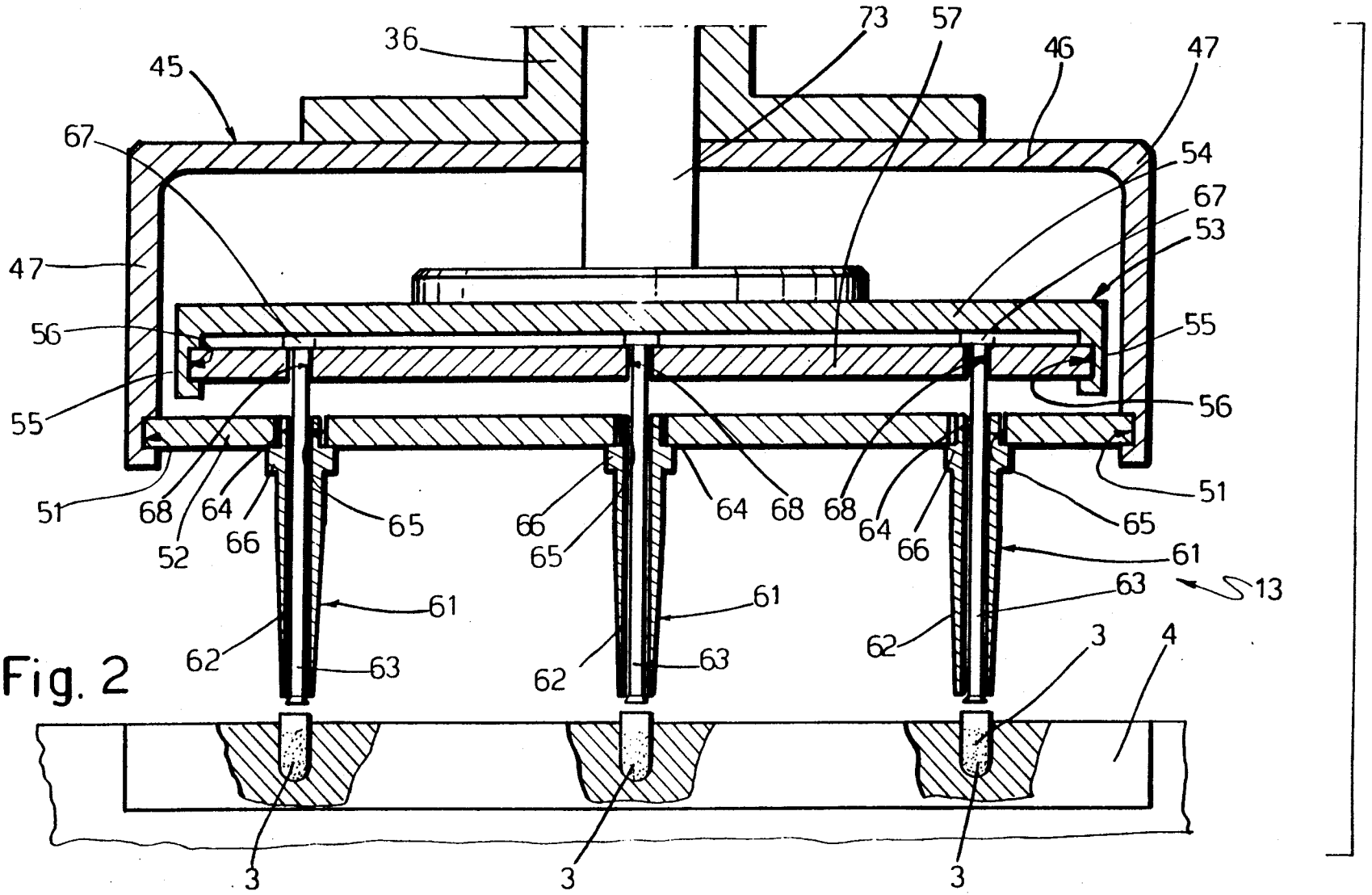
FIG. 2 is a section to an enlarged scale of a component of the machine of FIG. 1.

With reference to FIG. 2 the unit 13 comprises a box 45 with a horizontal upper wall 46 made mechanically rigid with the shaft 36 and two side walls 47 vertically extending downwards. A third side wall consists of a closure plate 48 (FIG. 1) hinged along an edge of the wall 46. At the lower edge of the walls 47, on their inner face, there is provided a respective groove 51 extending parallel to the corresponding edge. The grooves 51 are engaged by two opposite perimetral edges of a rectangular plate 52.

Within the box 45 there is installed a second box 53 similar to the box 45 but of smaller dimensions. Actually the box 53 comprises a base wall 54 parallel to the wall 46 and two side walls 55 of small height extending parallel to the walls 47 provided with the groove 51. Just as said walls 47 the walls 55 also have a respective groove 56 on their inner face.

The grooves 56 are engaged by two opposite perimetral edges of a rectangular plate 57 which, therefore, is at a higher level than the plate 52.

The unit 13 is provided with a plurality of measurers 61 which, in this embodiment, are disposed according to a plurality of lines and columns. The measurers 61 are supported by the plates 52 and 57 which can be extracted from the unit 13 at the same time; this can be done very easily since first rotating the closure plate 48 and then manually removing them from the respective grooves 51 and 56 is enough. This enables the unit 13 to accept plates similar to the plates 52 and 57 but with a different disposition or with a different number of measurers 61.

Each measurer 61 comprises an internally hollow body 62 supported by the plate 52 and a pin 63 which is inside the body 62 and which is supported by the plate 57. The body 62 has an externally threaded upper end 64 which is screwed in a threaded through bore 65 provided in the plate 52. The end 64 is screwed until a ring-shaped projection 66 defined in the body 62 comes into contact with the lower face of the plate 52. The projection 66 constitutes a reference point for the correct levelling of the various measurers 61. At its upper end the pin 63 has a wide head 67 which remains in the space defined between the wall 54 and the plate 57. The thickness of said head 67 is substantially equal to the distance between the wall 54 and the plate 57. The pin 63 extends downward through a through bore 68 provided in the plate 57 and coaxial to a respective bore 65.

With reference to FIGS. 1 and 2 the means 17 is able to bring about a translation of the box 53 in relation to the box 45 and namely a translation of the pins 63 in relation to the bodies 62. In particular the means 17 operates a pneumatic cylinder 71 installed within the box 35 in an intermediate wall 72. In its turn the cylinder 71 brings about the axial translation between two stop positions of a vertical shaft 73 which, through the interior of the shaft 36, extends inside the box 45 where it mechanically connects with the wall 54 of the box 53.

In use, when the element 14 is close to the frame 26 the means 16 produces downward translation of the device 12 and therefore of the dosage unit 13. During this phase the means 17 keeps the shaft 73 in the upper stop position which includes a predetermined distance between the lower end of the pin 63 and the lower end of the body 62. That is why there is defined in it a chamber which, when the measurer 61 penetrates the layer of powder 2, fills up with the latter.

During this sampling phase the container 9 does not move. Then the means 16 releases device 12 free to go back up under the action of the spring 42 and the means 15 translate the element 14 and therefore the device 12 toward the area concerned with the release of the powder 2. The means 17 can now produce, through the cylinder 71, the downward translation of the pins 63 only which press the powder 2 toward the seats to be dosed. It is apparent that the position of the cylinder 71 in relation to its support or the axial position of the shaft 73 in relation to the cylinder 71 can be adjusted so as to stabilize the height of the chamber, defined in the body 62, and therefore the amount of powder 2 sampled.

The machine 1 is provided with a sensor 81 for finding defects or missing seats to be dosed. In case such drawbacks are found the computer 18 is able to prevent the device 12 from translating during the sampling phase.

Preventing the contact between the small wheel 41 and the appendix 37 or making a telescopic or axially translatable pin 38 or making a pin 38 which rotates about a vertical axis is enough to prevent said translation. The means 16 could be shaped so as to cause the pin 38 to move according to the modalities just mentioned as well.

Figure 5:
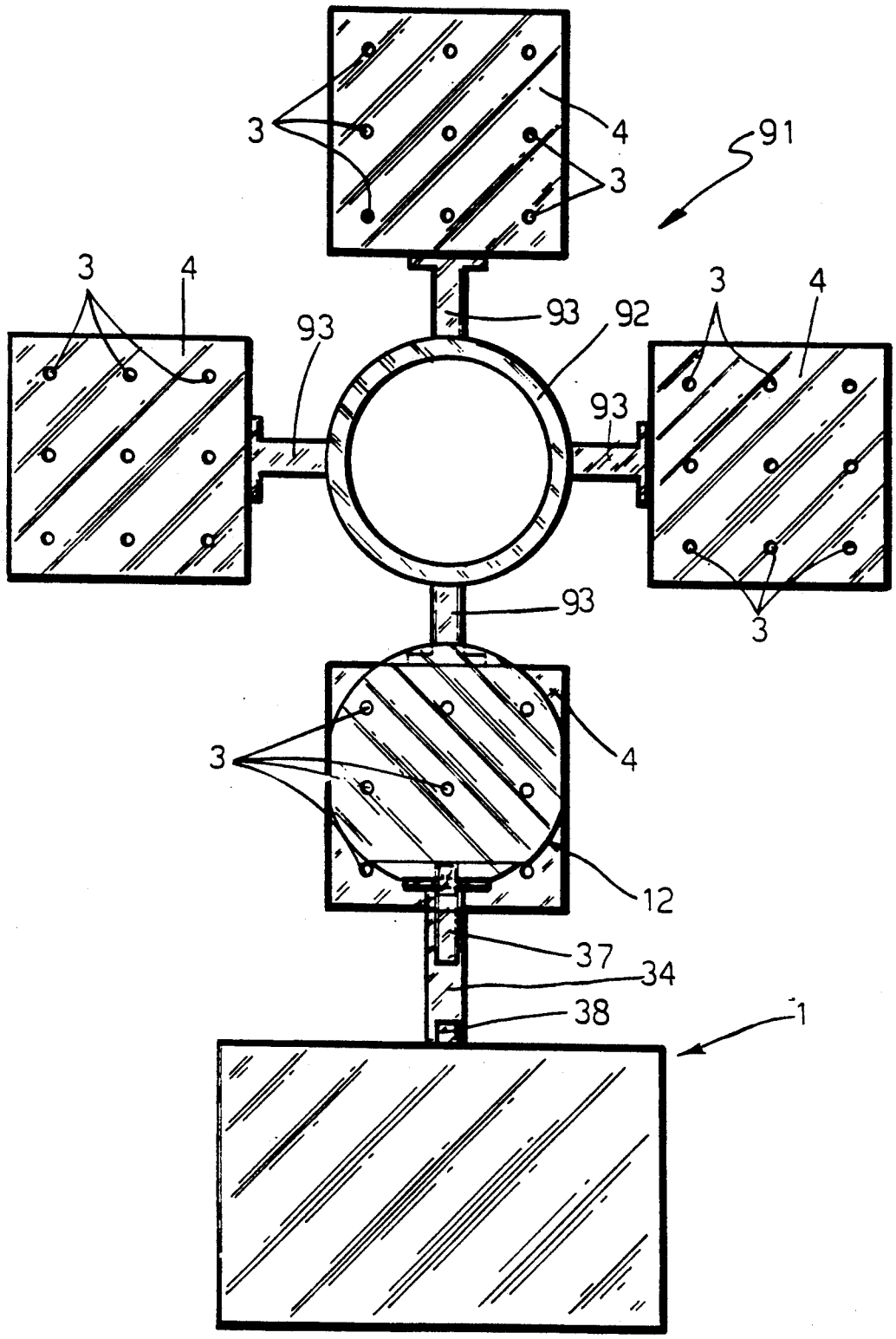
FIG. 5 is a diagram of a machine successive to the machine of FIG. 1.

As already mentioned the seats to be dosed and their conveyance or motion can be varied. Naturally the seats to be dosed must be disposed with the same modalities as the measurers 61. The seats can be defined by the capsules 3, which in their turn can be carried by a plate or chain conveying belt which follows a predetermined run along the plant of which the machine 1 is part or, as shown in FIGS. 2 and 5, can be carried by the rectangular plate 4 of a machine 91. This machine comprises a rotating shaft 92 provided with a plurality of radial arms 93 each carrying a respective plate 4. During the rotation of the shaft 92 a first plate 4 comes below the unit 13 to be able to accept the powder 2. In FIG. 5 the machine 1 is diagrammatically shown for simplicity.

The machine 91 could be provided with a station for closing the capsules 3 which, during the dosage phase of the first plate 4, operates said closing in a second plate 4, and with a station for the release of a plate 4 which has already gone through the closing station, and finally with a final station in which a plate 4 with the capsules 3 still to be dosed is taken. The machine 1 could be provided also with a station for compacting the powder 2 and/or with a second dosage station possibly defined by a second machine 1. It is apparent that the aforedescribed considerations also apply to the other types of seats to be dosed; for these the packing system may vary as for example for the blister sheet 6 on which there is applied a coating film. The advantages of the present invention are apparent from the aforegoing description.

In particular there has been constructed a machine which, as regards the amount, can dose the powder with the utmost precision since it is provided with a dosage unit which is not subject to vibrations, its motion being nonrotary. The dosage precision is due also to the fact that the machine 1 is provided with only one dosage unit even though the dosage can be multiple. Therefore all that finishing of pinpoint accuracy for the levelling between the dosage units is not required.

The set of measurers 61 can be interchangeable, by means of simple operations, so as to make it possible to choose the number and the relative disposition of the measurers 61. The seats to be dosed can be widely varied as well as the type of conveyance of the latter. It is deduced from all this that the machine 1 has high adaptability to the type of dosage unit and to the seats to be dosed; this leads to a greater use, with an obvious saving, in comparison with the machines made for a single type of dosage unit or seats to be dosed. The dosage unit is configured so as to define the levelling between the different measurers 61 automatically and a simultaneous motion control for said measurers 61. The configuration of the machine 1 and the type of motion of its components enables obtaining, even with a single dosage unit, an hourly production greater than the hourly production of current alternating machines to such an extent that it is comparable to the hourly production of rotary machines. Besides, unlike current alternating machines, the machine 1 can be provided with a sensor to find defects or missing seats to be dosed and with means which prevent the powder sample meant for these seats from being taken. The machine 1 is compact and of small dimensions, which makes it easier to be inserted in a plant. Finally it should be underlined that the machine 1 is of simple construction and therefore of low production cost.

Finally it is apparent that modifications can be made to the machine described and shown provided they do not leave the scope of protection of the present invention.

In particular the container 9 could be fixed whereas the device diagrammatically shown as a block 25 could be mobile so as to perform the mixing and levelling operations during its motion. Besides, the means 11, 15, 16 and 17 for moving the components of the machine 1 can be of various types as, for example, electric motors or fluid actuators.

At this point it should be noted that some means could be part of a single system in a position to directly or indirectly move more than one component. For instance the motion of the container 9 could be used through various cams or mechanisms to set in motion the element 14 as well as the pin 38 and therefore the device 12.

I claim:

1. A machine for dosing powdered pharmaceuticals comprising:

a container containing a horizontal layer of powdered pharmaceutical, a dosage unit, a device supporting said dosage unit, an element supporting said device and comprising a first body having a vertical axis, means for displacing said first body rectilinearly, in horizontal translation parallel to the layer of powdered pharmaceutical, between first and second horizontally displaced positions, said device and said element being translated with said first body between said first and second positions, said dosage unit in said first position of said first body being located to remove a measured amount of the powdered pharmaceutical from said layer thereof in said container, said dosage unit in said second position of said first body being located to dose the measured amount of pharmaceutical into a receiving seat therefor, said means for displacing said first body including a first drive means and a mechanical system connected to the first drive means for translating said first body solely horizontally between said first and second positions, a second drive means for translating said dosage unit along said vertical axis of said first body relative to said element when the first body is in said first position to cause said dosage unit to penetrate into said layer of powdered pharmaceutical and remove said measured amount thereof, and third drive means for releasing said measured amount of powdered pharmaceutical from said dosage unit into said receiving seat when said first body is in said second position, said first and second drive means being independently operable to displace the dosage unit independently and respectively in horizontal and vertical directions.

2. Machine as claimed in claim 1, wherein said device comprises a second body disposed at a higher level than said first body, and a first vertical shaft mechanically rigid with said second body, which extends through a first vertical through bore provided in said first body, and which has a lower end supporting said dosage unit.

3. Machine as claimed in claim 2, wherein said second means effects downward and upward translation of a first pin which, when said element is in said first position, acts during its downward translation on an appendix of said second body to produce an equal downward translation of the latter and of said dosage unit.

4. Machine as claimed in claim 3 comprising elastic means between said first body and said second body for opposing the downward translation of said second body and for producing upward translation when said first pin also translates upwards.

5. Machine as claimed in claim 3, wherein said dosage unit comprises at least one measurer including a third internally hollow body able to translate together with said second body and a second pin within said third body and able to axially translate, under the operation of said third means, between an upper stop position in which between its lower end and the lower end of said third body there is defined inside the latter a chamber which fills up with said powder during removal thereof, and a lower stop position in which said second pin said powder downwards.

6. Machine as claimed in claim 5, wherein said dosage unit further comprises:

a first box having a horizontal upper wall mechanically rigid with said first shaft and two opposite side walls which extend vertically downwards and have lower ends supporting a first plate which in turn supports said third body of said measurer; and a second box within said first box and including a horizontal upper wall and two opposite side walls which extend vertically downwards and have lower ends supporting a second plate which in turn supports said second pin.

7. Machine as claimed in claim 6, wherein said third body has an externally threaded upper end screwed in a second threaded through bore provided in said first plate.

8. Machine as claimed in claim 7, wherein said third body includes an external projection able to come into contact with said first plate and therefore able to constitute a reference point for the screwing of said third body into said second bore.

9. Machine as claimed in claim 6, wherein said second pin has an upper end with a wide head which stays in a space defined between said upper wall of said second box and said second plate; said second pin extending downward through a third through bore provided in said second plate and coaxial to said second bore.

10. Machine as claimed in claim 6, wherein said third means translates a second vertical shaft which axially passes through said first shaft to extend inside said first box where it is mechanically connected to said second box; the translation of said second pin in relation to said third pin being thereby transmitted by said second shaft.

11. Machine as claimed in claim 6, wherein an assembly defined by said first and second plates and by said measurer is extractable from said dosage unit by a manual operation which allows a horizontal sliding; said first and second plates having two opposite side walls which engage respective grooves provided in corresponding supporting side walls.

12. Machine as claimed in claim 5, wherein said dosage unit comprises a plurality of said measurers (61).

13. Machine as claimed in claim 1, wherein said receiving seat consists of capsules of hard gelatin.

14. Machine as claimed in claim 1, wherein said receiving seat consists of blisters defined on a sheet of blister type packing.

15. Machine as claimed in claim 1, wherein said receiving seat consists of glass or plastic bottles.

16. Machine as claimed in claim 1, wherein said receiving seat is provided on a plate.

17. Machine as claimed in claim 1, comprising means for conveying a plurality of said seats into a position to receive the powdered pharmaceutical.

18. Machine as claimed in claim 1, comprising a sensor for detecting defects and/or empty seats to be dosed to prevent downward translation of said device and penetration of said dosage unit into the pharmaceutical powder.

19. Machine as claimed in claim 1, comprising means for rotating said container about a vertical axis during a powder releasing phase and an interruption of said rotation during a powder sampling phase.

20. Machine as claimed in claim 1, wherein said container comprises means able to mix said powder and to shave the powder layer so as to form an even layer thereof.

* * * * *